US005356196A

United States Patent [19]

Chuang

[11] Patent Number: 5,356,196

[45] Date of Patent: Oct. 18, 1994

[54] HEIGHT-ADJUSTABLE FOLDING WALKING CHAIR

[76] Inventor: Ruey-Chang Chuang, No. 116 San Yuan Street, Ku Ting Dist., Taipei, Taiwan

[21] Appl. No.: 73,083

[22] Filed: Jun. 8, 1993

[51] Int. Cl.[5] ..... A47D 13/04

[52] U.S. Cl. ..... 297/5; 297/344.18; 482/68

[58] Field of Search ..... 297/5, 6, 344.12, 344.18; 280/87.021, 87.041, 87.05, 87.051; 482/66, 68; 135/74, 67

[56] References Cited

U.S. PATENT DOCUMENTS 4,211,426 7/1980 Motloch ..... 482/68 X
4,770,410 9/1988 Brown ..... 482/68
4,890,853 1/1990 Olson ..... 297/5 X

*Primary Examiner*—Laurie K. Cranmer
*Attorney, Agent, or Firm*—Bacon & Thomas

[57] ABSTRACT

The present disclosure relates to a walking chair, more particularly to a walking chair including two sets of movable joints and a set of extensible support. The walking chair of the present invention mainly comprises an H-shaped support frame in which two parallel sliding columns are movably inserted, a lower protective ring which is provided with universal casters and is attached at its rear portion to the H-shaped support frame with a movable joint which allows the lower protective ring to be folded down toward the H-shaped support frame, and an upper protective ring which is attached at its rear portion to top ends of the two sliding columns with a movable joint which allows the upper protective ring to be folded upward toward the H-shaped support frame. The upper protective ring may have different seat accessories attached thereto to meet different requirements or conditions. The sliding columns can be adjusted to any desired height and then be locked within the H-shaped support frame and the whole walking chair can be folded to save space occupied by it when it is not in use.

4 Claims, 8 Drawing Sheets

HEIGHT-ADJUSTABLE FOLDING WALKING CHAIR

BACKGROUND OF THE INVENTION

Most of the conventional walking chairs are integrally formed and therefore, can not be folded to save as much space as possible when they are not in use; moreover, their height is not adjustable to match the length of a baby's legs and/or the height of a dining table, and they can not be provided with different seats to meet the requirements in different conditions.

It is therefore tried by the inventor to develop a walking chair which has movable joints allowing the walking chair to be-folded at an angle of 90 degrees, and an extensible H-shaped support which can be adjusted to different heights to meet the height of a dining table and/or the length of the baby's legs.

SUMMARY OF THE INVENTION

A primary object of the present invention is to provide a walking chair which can be folded in two steps by means of two sets of movable joints and two sets of manually controlled press tabs thereon.

Another object of the present invention is to provide a walking chair which can be adjusted to have different heights by means of an extensible H-shaped support and the press tabs thereon.

A further object of the present invention is to provide a walking chair having a specially designed upper protective ring which allows the walking chair to use with different seats to meet requirements in different conditions.

DETAILED DESCRIPTION OF THE PREFERRED EMBODIMENTS

Figure 1:
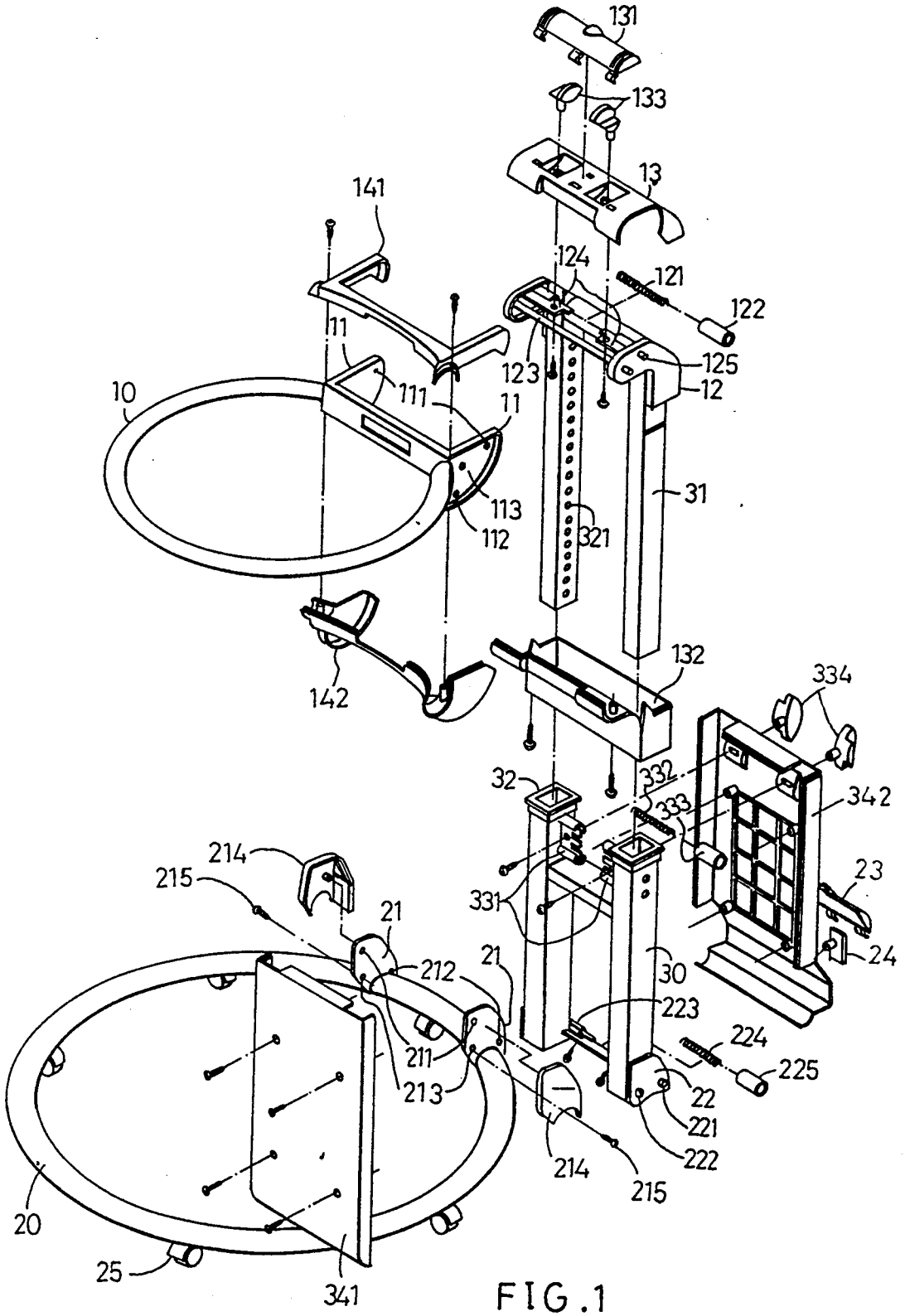
FIG. 1 is a disassembled three-dimensional perspective of the walking chair according to the present invention.
Figure 2:
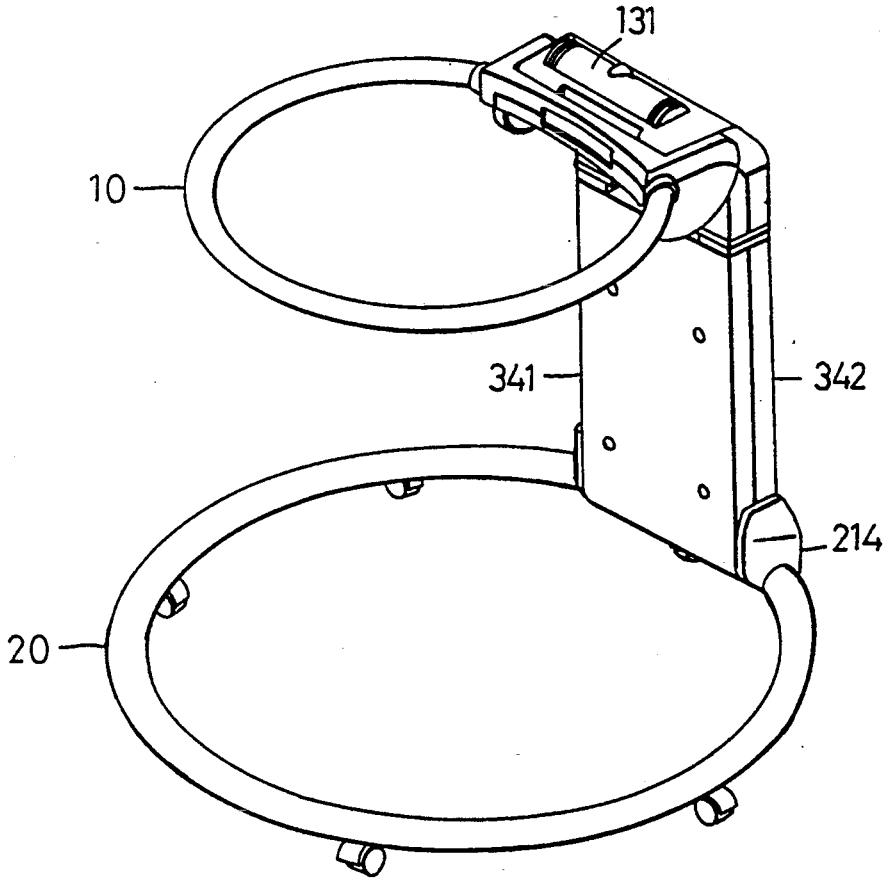
FIG. 2 is an assembled three-dimensional perspective of the walking chair of the present invention in an extended condition.

Referring to FIG. 1. The walking chair according to the present invention mainly consists of three parts, namely, a folding upper protective ring, a folding lower protective ring, and an extensible H-shaped support.

The folding upper protective ring mainly includes an upper protective ring 10; a pair of segmental plates 11 forming a rear portion of the upper protective ring 10 and having an upper shaft hole 111; a lower shaft hole 112 and a fixed shaft hole 113 formed on each of the segmental plates 11; a pair of segmental side covers 12; a fixed shaft 123 supported on and between the segmental side covers 12 and having its two ends projected out of the segmental side covers 12; a pair of toothed steel plates 124 separately disposed on the segmental side covers 12 with their outer shaft-like ends 125 separately projecting out of the segmental side covers 12; a spring 121 and a spring sleeve 122 enclosing the spring 121, both being supported on and between the pair of toothed steel plates 124. Screws are used to separately thread through the toothed steel plates 124 so that the screws extend upward to pass a top cover 13 through openings formed thereon to tighten a pair of symmetrical press tabs 133 above the top cover 13.

When the pair of press tabs 133 are pressed inwardly at the same time, the spring 121 shall be Compressed and the toothed steel plates 124 and their projected shaft-like ends 125 shall be driven to retract inward. When the press tabs 133 are released, the spring 121 shall push the toothed steel plates 124 and their projected shaft-like ends 125 to move outwardly.

The fixed shaft holes 113 are separately but symmetrically formed on the two segmental plates 11 for receiving two ends of the fixed shaft 123 being supported on and between a front portion of the segmental side covers 12 so that the upper protective ring 10 can pivot about the fixed shaft 123 at the time the press tabs 133 are inward pressed. When the upper protective ring 10 is in a normal operation position, the upper shaft holes 111 symmetrically formed on the segmental plates 11 engage with the two projected shaft-like ends 125 of the toothed steel plates 124.

Figure 3:
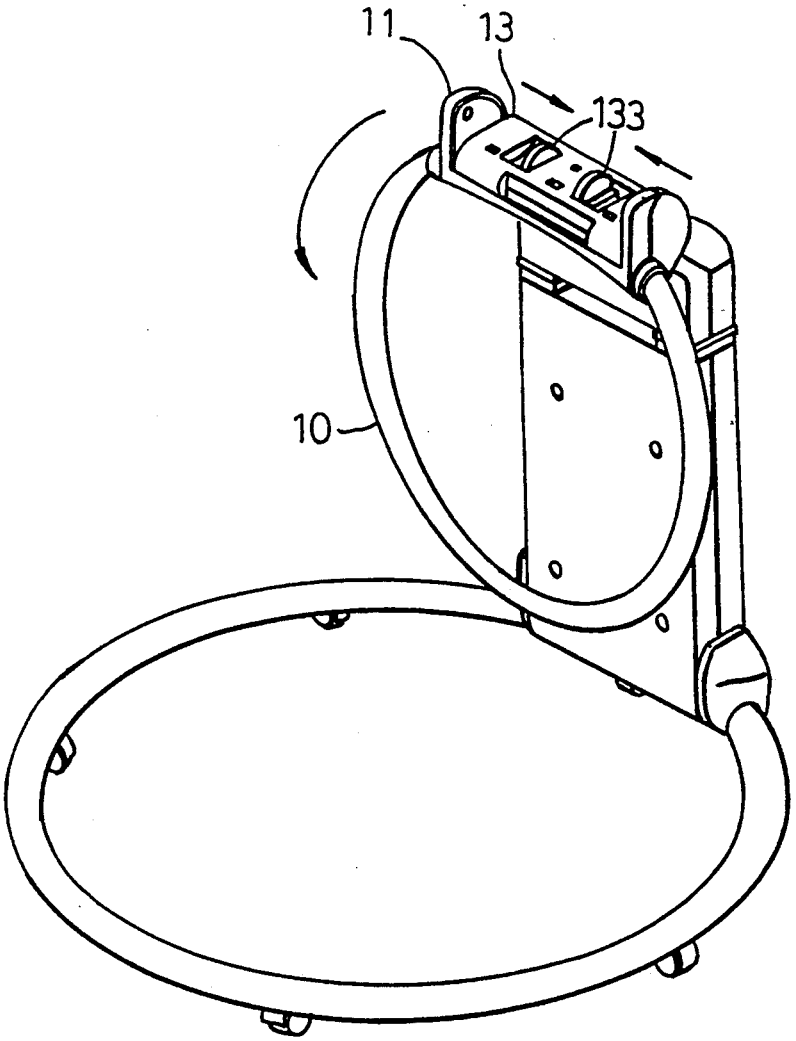
FIG. 3 illustrates the walking chair of the present invention of which the upper protective ring has been downward folded.

When the upper protective ring 10 is to be folded downward, with the two press tabs 133 pressed inward at the same time, driving the projected shaft-like ends 125 of the toothed steel plates 124 to retract inward, so as to make the segmental plates 11, and accordingly, the upper protective ring 10, to pivotly turn downward about the fixed shaft 123. The fixed shaft 123 has two ends received in the two fixed shaft holes 113 on the segmental plates 11. Accordingly, the upper protective ring 10 is finally folded downward 90 degrees to be substantially parallel to the H-shaped support (as shown in FIG. 3) and the two lower shaft holes 112 symmetrically formed on the segmental plates 11 at a lower position than that of the upper shaft holes 111 move upward to the positions. At those positions, the projected shaft-like ends 125 of the toothed steel plates 124 locate, releasing the two press tabs 133, so as to allow the two projected shaft-like ends 125 to project out of the segmental side covers 12 again and pass through the shaft holes 112 on the segmental plates 11, locking the upper protective ring 10 in a downward folded position.

The folding lower protective ring mainly includes a lower protective ring 20; a pair of shifting plates 21 disposed at a rear portion of the lower protective ring 20 and having an upper shaft hole 211; a lower shaft hole 212 and a fixing screw hole 213 formed on each of the shifting plates 21; two movable joint steel plates 22 attached to two lower ends of the H-shaped support 30 and each having a fixing screw hole 222 formed thereon; a pair of steel rods 223 separately abutting against two lower rear sides of the H-shaped support 30 so that they are supported on and between the movable joint steel plates 22 with their two ends 221 in a larger diameter extending through and projecting out of the movable joint steel plates 22; a spring 224 and a spring sleeve 225 enclosing the spring 224, both being supported on and between the pair of steel rods 223; and screws being used to separately thread through the steel rods 223 so that the screws extend backward to pass a rear cover 342 through openings formed thereon to tighten a pair of symmetrical press tabs 24 outside the rear cover 342.

The H-shaped support 30 is connected at it two lower ends to the lower protective ring 20 by putting the H-shaped support 30 between the two shifting plates 21, and screwing two fixing screws 215 through the fixing screw holes 213 formed on the shifting plates 21, and the fixing screw holes 222 formed on the movable joint steel plates 22, with the shaft holes 212 engaging with the projected ends 221 of the steel rods 223.

When the pair of press tabs 24 are pressed inward at the same time, the spring 224 shall be compressed and the steel rods 223 and their projected ends 221 shall be driven to retract inward. As the press tabs 24 are released, the spring 224 shall urge the steel rods 223 and their now retracted ends 221 to move outwardly.

Figure 4:
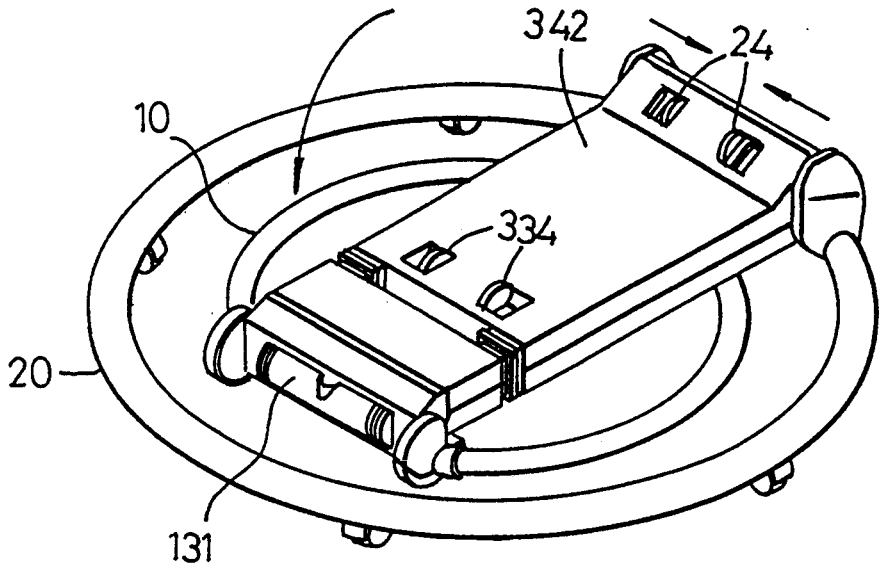
FIG. 4 illustrates the walking chair of the present invention of which the lower protective ring has been upward folded.

When the steel rods 223 and their projected ends 221 retract inwardly disengaging from the shaft holes 212 of the shifting plates 21 on the lower protective ring 20, the H-shaped support 30 is allowed to pivot about the screws 215 in the fixing screw holes 213, 222 and turns downward 90 degrees (as shown in FIG. 4) until the now retracted ends 221 of the steel rods 223 move to positions corresponding to the upper shaft holes 211. Release the two press tabs 24, allowing the spring 224 to push the steel rods 223 and their two ends 221 to move outwardly and engage with the shaft holes 211, locking the lower protective ring 20 in a folded position. Universal casters 25 are connected to the lower protective ring 20 for the walking chair to move smoothly.

The extensible H-shaped support part includes an H-shaped support frame 30; two symmetrical and parallel sliding columns 31 each having a plurality of through holes 321 formed at an inner side wall thereof and connected at their top portion to an inner side of one of the segmental side covers 12; two sliding column entrances 32 through which the sliding columns 31 are inserted into the H-shaped support frame 30; a pair of symmetrical toothed steel plates 331 oppositely disposed on and between inner side walls of the H-shaped support frame 30 at positions just below the entrances 32; a spring 332 and a spring sleeve 333 enclosing the spring 332, both being supported on and between the toothed steel plates 331; a lower cover 132; a rear cover 342; and a pair of press tabs 334.

The two sliding columns 31 pass through the lower cover 132 and extend into the H-shaped support frame 30 via the two entrances 32, movable up and down in the H-shaped support frame 30. Screws are used to thread through the two toothed steel plates 331 via holes formed thereon and further extend through the rear cover 342 via preformed holes thereon to securely connect the two press tabs 334.

Figure 6A:
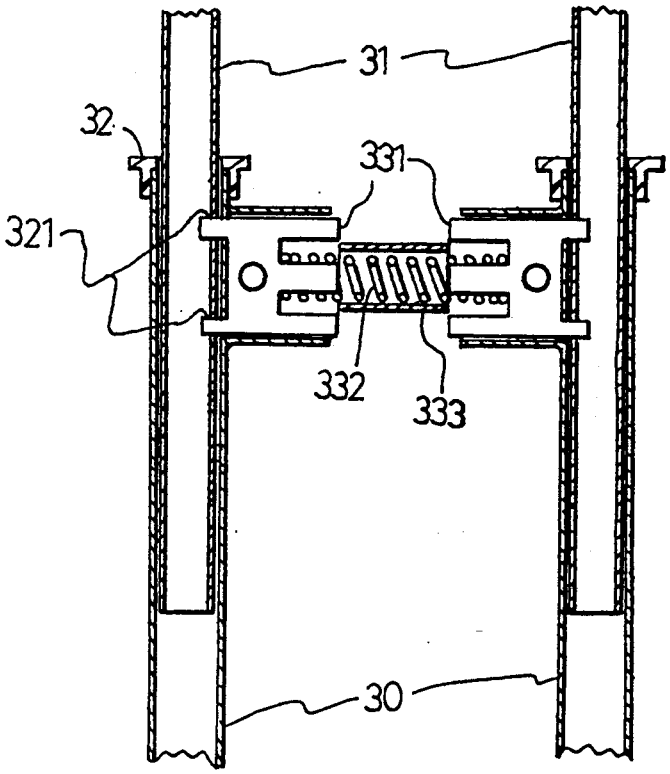
FIGS. 6A and 6B illustrate in more details the manner in which the H-shaped support is extended or retracted.
Figure 6B:
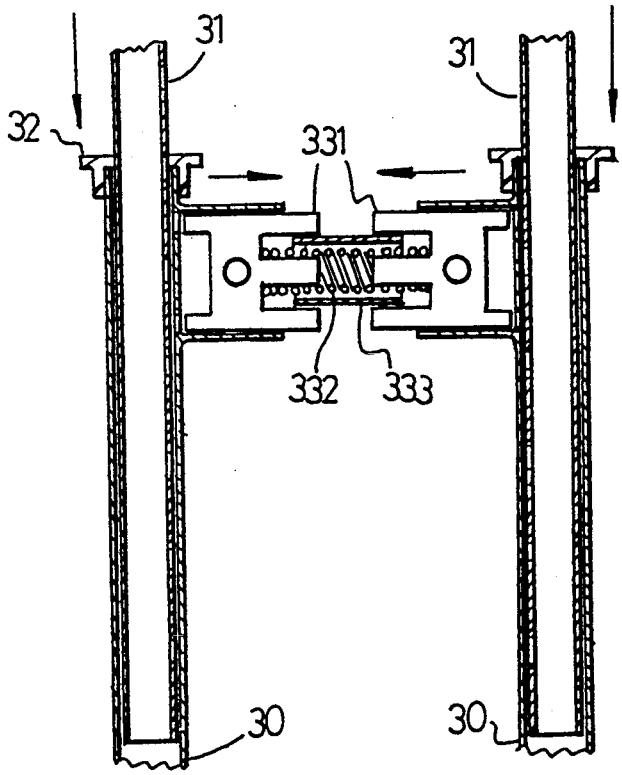

Please now refer to FIGS. 6A and 6B. The toothed steel plates 331 each has two rear ends laterally extending into the H-shaped support frame 30 and engaging with two of the through holes 321 formed on inner side wall of the two sliding columns 31. When the two press tabs 334 are pressed inward at the same time, the two toothed steel plates 331 are pulled inward toward each other and their rear ends disengage from the through holes 321 and retract back out of the H-shaped support frame 30, as shown in FIG. 6B. When the two press tabs 334 are released at the same time, the two toothed steel plates 331 shall abut against the inner side walls of the H-shaped support 30 with their rear ends extending into two of the through holes 321 on the sliding columns 31, locking the sliding columns 31 at a desired height, as shown in FIG. 6A.

Figure 5:
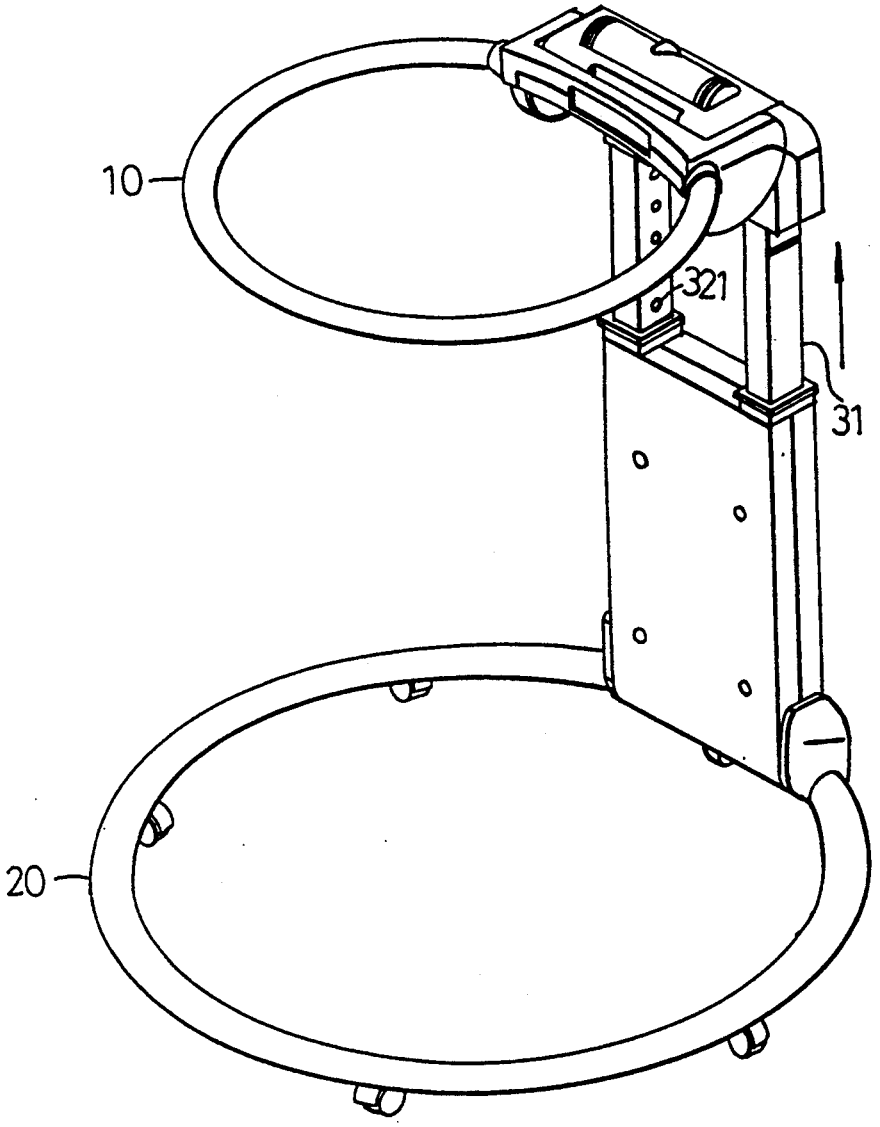
FIG. 5 illustrates the manner in which the H-shaped support is extended upward to have a larger height.

To adjust the height of the walking chair, just press the two press tabs 334 at the same time, causing the two toothed steel plates 331 and their rear ends to disengage from the through holes 321 on the sliding columns 31; and adjust the sliding columns 31 to a desired height, and release the two press tabs 334, allowing the toothed steel plates 331 to move outward and the rear ends thereof to extend into and engage with corresponding through holes 321 on the sliding columns 31, as shown in FIG. 5.

To make the present invention look better and safer in use, the pair of segmental plates 11 of the upper protective ring 10 may be further equipped with a top cover 141 and bottom cover 142. The folding part of the upper protective ring 10 may be provided with a tab cover 131, the H-shaped support 30 may be further provided with a front cover 341 to engage with the rear cover 342 by means of screws, the folding lower protective ring 20 may be further equipped with a tab cover 23 above the two rear press tabs 24. The two shifting plates 21 on rear portion of the lower protective ring 20 may each be equipped with a side cover 214.

Figure 7:
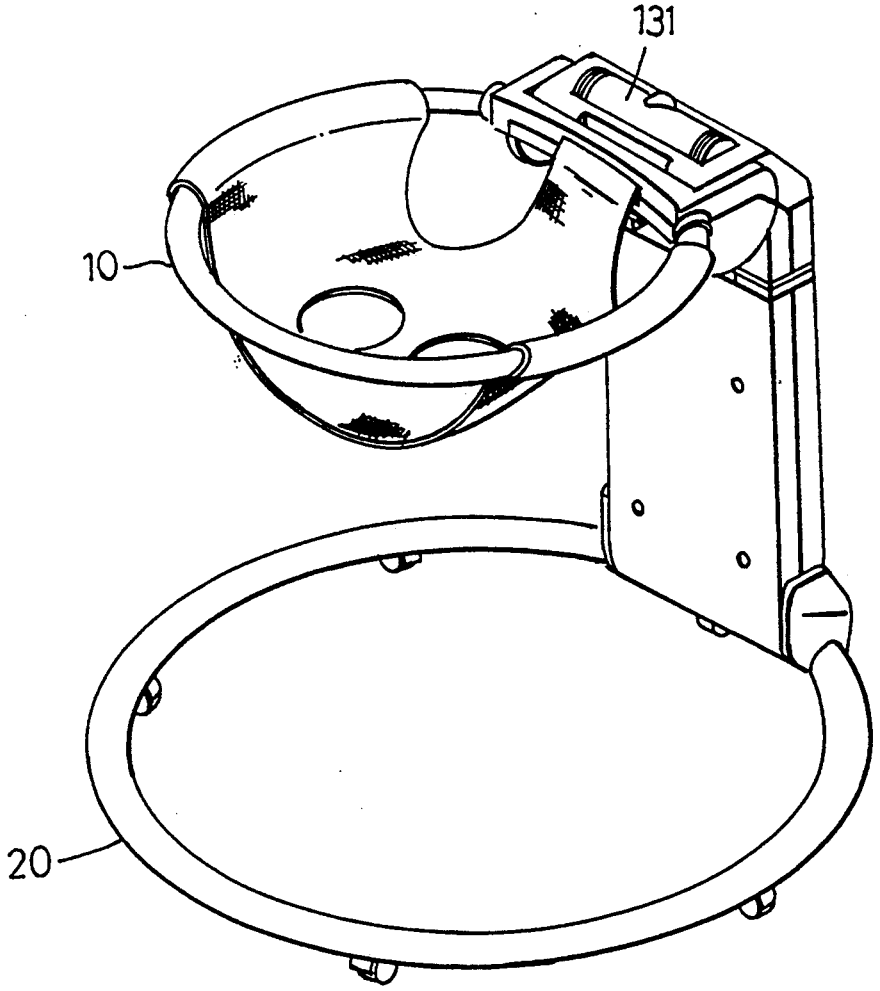
FIG. 7 shows the walking chair of the present invention on which a conventional soft seat is connected to the upper protective ring.
Figure 8:
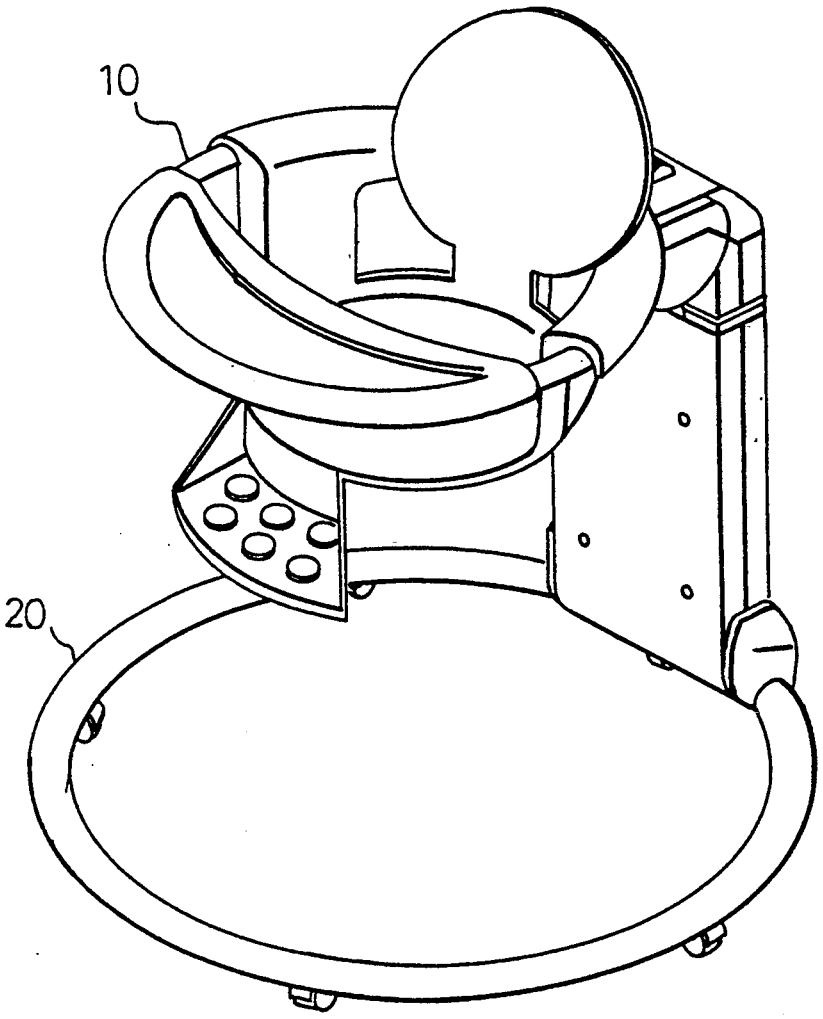
FIG. 8 shows the walking chair of the present invention on which a novel seat and a front table member are connected to the upper protective ring.

To meet different needs, a soft seat may be attached to the upper protective ring 10 at three adequate points by means of velcro tape, for example. The seat may be formed with two lower holes for a baby using the walking chair to extend its legs therethrough (as shown in FIG. 7). Alternatively, a chair with a back and foot step member may be attached to the upper protective ring 10. The chair may be even further provided with soft pads on the back and the seat so that it is more comfortable in use. Moreover, a generally crescent front panel may be provided on the upper protective ring as a cute dining table, as shown in FIG. 8.

What is claimed is:

1. A height-adjustable folding walking chair comprising a folding upper protective ring part;

a folding lower protective ring part, and an extensible H-shaped support having two parallel sliding columns movably disposed therein;

said folding lower protective ring part being connected to bottom ends of said H-shaped support and having been mounted with adequate numbers of universal caster;

said folding upper protective ring part being connected to top ends of said two sliding columns and including an upper protective ring;

a pair of segmental plates forming a rear portion of said upper protective ring and having an upper and a lower shaft holes and a fixed shaft hole formed on each of said segmental plates;

a pair of segmental side covers;

a fixed shaft supported on and between said segmental side covers and having its two ends projected out of said segmental side covers;

a pair of toothed steel plates separately disposed on said segmental side covers with their outer shaft-like ends separately projecting out of said segmental side covers;

a spring and a spring sleeve enclosing said spring, both being supported on and between said pair of toothed steel plates;

two top press tabs being separately screwed to said toothed steel plates;

whereby when said two top press tabs are pressed inward at the same time said two toothed steel plates and their projected shaft-like ends are driven to retract inward and therefore, allowing said upper protective ring to pivot about said fixed shaft 123, and when said press tabs are released said toothed steel plates and their projected shaft-like ends can move outward.

2. A height-adjustable folding walking chair as claimed in claim 1, wherein said folding lower protective ring part comprises a lower protective ring, two shifting plates symmetrically disposed at a rear portion of said lower protective ring and each having a fixing screw hole, an upper and a lower shaft holes formed thereon, a pair of movable joint steel plates separately attached to outer bottom ends of said H-shaped support and each having a fixing screw hole and a projected shaft hole formed thereon, two steel rods separately and oppositely attached to said two movable joint steel plates with rear ends of said steel rods each outward extends through said shaft hole on said movable joint steel plates and said upper or said lower shaft hole on said shifting plates, a spring and a spring sleeve enclosing said spring both being supported on and between said two steel rods, and two press tabs being separately screwed to said two steel rods; said lower protective ring being securely attached to said H-shaped support by positioning said H-shaped support between said two shifting plates, pivotly fixing said H-shaped support to said shifting plates with fixing screws threading through said two fixing screw holes on said two shifting plates and said two fixing screw holes on said movable joint steel plates, and said projected ends of said two steel rods each engaging with said lower shaft hole on said shifting plates; said two press tabs, when being pressed inward at the same time, driving said two steel rods and their projected ends to retract inward from said movable joint steel plates via said shaft holes thereon and thereby, allowing said lower protective ring to pivotly turn upward about said fixing screws threaded through said movable joint steel plates and said shifting plates, and said two press tabs, when being released from a pressed state, allowing said two steel rods and their now retracted ends to project out of said movable joint steel plates via said shaft holes thereon.

3. A height-adjustable folding walking chair as claimed in claim 1, wherein said extensible H-shaped support comprises an H-shaped support frame, said two parallel sliding columns being movably mounted within said H-shaped support frame and each having a plurality of through holes formed at an inner side wall thereof, a pair of symmetrical toothed steel plates oppositely disposed on inner side walls of said H-shaped support frame nearby top ends thereof with two rear ends of each of said toothed steel plates backward extending through said H-shape support frame and into two of said through holes on said sliding columns, a spring and a spring sleeve enclosing said spring both being supported on and between said two toothed steel plates, and two rear press tabs being separately screwed to said two toothed steel plates by means of fixing screws such that when said two rear press tabs are pressed inward at the same time said two toothed steel plates and their rear ends are pulled inward and disengage from said through holes on said two sliding columns, allowing said sliding columns to move up or down to a desired height, and, when said two rear press tabs are released from their pressed status said two toothed steel plates move outward with their rear ends extending back into said through holes on said two sliding columns.

4. A height-adjustable folding walking chair as claimed in claim 1, wherein said upper protective ring has a soft seat with two leg holes attached thereto at three points by means of velcro tapes, for example, or alternatively, has a chair having padded back and seat and a foot step member attached thereto and a crescent front panel forming a dining table attached thereto opposite to said chair.

* * * * *